US007178370B2

(12) United States Patent
Engel

(10) Patent No.: US 7,178,370 B2
(45) Date of Patent: Feb. 20, 2007

(54) BIOMETRIC SELF-CONTAINED GRAVITY-OPERATED ILLUMINATED TACTILE GUN SAFE

(76) Inventor: Raymond C. Engel, 2351 Tenaya Dr., Modesto, CA (US) 95354

( * ) Notice: Subject to any disclaimer, the term of this patent is extended or adjusted under 35 U.S.C. 154(b) by 0 days.

(21) Appl. No.: 10/998,481

(22) Filed: Nov. 29, 2004

(65) Prior Publication Data

US 2006/0112741 A1 Jun. 1, 2006

Related U.S. Application Data

(63) Continuation-in-part of application No. 10/638,876, filed on Aug. 8, 2003, now abandoned.

(51) Int. Cl.
*E05B 73/00* (2006.01)

(52) U.S. Cl. ..... 70/63; 49/360; 109/50; 109/51; 312/242

(58) Field of Classification Search ..... 70/63; 109/50–52, 17, 18, 73; 312/242, 245, 297; 52/205, 204.51; 49/360; 224/243, 911, 224/912; 206/317; 248/551–553; 42/70.11; 211/64

See application file for complete search history.

(56) References Cited

U.S. PATENT DOCUMENTS 2,331,655 A * 10/1943 Colwill ..... 312/227
3,871,197 A * 3/1975 Waxgiser et al. ..... 70/63
4,651,544 A * 3/1987 Hungerford ..... 70/63
4,768,021 A * 8/1988 Ferraro ..... 340/568.1
5,111,755 A * 5/1992 Rouse ..... 109/25
5,161,396 A * 11/1992 Loeff ..... 70/63
5,329,865 A * 7/1994 McWard ..... 109/50
5,701,770 A * 12/1997 Cook et al. ..... 70/63
5,901,589 A * 5/1999 Cordero ..... 70/63
5,987,941 A * 11/1999 Zocco ..... 70/63
6,363,760 B1 * 4/2002 Sigmond ..... 70/63
6,405,861 B1 * 6/2002 Siler et al. ..... 206/317
6,488,148 B1 * 12/2002 Woodson ..... 206/317
6,523,374 B1 * 2/2003 Owens ..... 70/63
6,694,673 B2 * 2/2004 Savard et al. ..... 49/200

* cited by examiner

*Primary Examiner*—Lloyd A. Gall
(74) *Attorney, Agent, or Firm*—Tod R. Nissle, P.C.

(57) ABSTRACT

A gun safe is provided. The safe includes a computer system and is readily located and used by a home owner under the darkness of night. The safe permits a loaded ready-to-use firearm to be stored and accessed safely and quickly. The safe door opens silently and uses motive power provided by gravity. The safe door will open only when the safe correlates biometric data of an individual with biometric data stored in the memory of the computer system used to operate the safe.

17 Claims, 3 Drawing Sheets

BIOMETRIC SELF-CONTAINED GRAVITY-OPERATED ILLUMINATED TACTILE GUN SAFE

CROSS-REFERENCE TO RELATED APPLICATIONS.

This application is a continuation-in -part of application Ser. No. 10/638,876, filed Aug. 8, 2003 now abandoned.

STATEMENT REGARDING FEDERALLY SPONSORED RESEARCH OR DEVELOPMENT

N/A.

THE NAMES OF PARTIES TO A JOINT RESEARCH OR DEVELOPMENT

N/A.

INCORPORATION-BY-REFERENCE OF MATERIAL SUBMITTED ON A COMPACT DISC

N/A.

BACKGROUND OF THE INVENTION (1) Field of the Invention.

This invention pertains to a safe.

More particularly, the invention pertains to a gun safe that is readily located and used by a home owner under the darkness of night.

In a further respect, the invention pertains to a safe that permits a loaded ready-to-use firearm to be stored and accessed safely.

In another respect, the invention pertains to a safe including a door that opens silently and that minimizes frictional forces generated during operation of the door such that the door likely will continue to operate silently and without sticking for an extended period of time.

(2) Description of Related Art including information disclosed under 37 CFR 1.97 and 1.98.

Gun safes are well known. Such conventional safes have disadvantages. First, the safes ordinarily do not permit rapid access. Second, the safes are difficult to operate in the dark. Third, a key or combination must be used to open each safe. Fourth, if a child locates the key or combination and is able to open the safe, serious injury can result. Gun locks have similar disadvantages because they often require combinations or keys to operate. As an alternate approach, some gun owners maintain guns in a partially disassembled state, usually as a safety precaution when children are present. Children have, however, been known to assemble successfully such guns, and to then utilize the guns with undesirable consequences.

Accordingly, it would be highly desirable to provide an improved system and method for storing a firearm.

Therefore, it is a principal object of the invention to provide an improved firearm storage method and system for a firearm.

A further object of the invention is to provide an improved method and apparatus for storing safely a loaded ready-to-use firearm.

Another object of the invention is to provide an improved method and apparatus for utilizing in the dark a firearm storage system.

Still a further object of the invention is to provide a self-contained firearm storage apparatus including a door that is opened with motive power supplied by the force of gravity.

Still another object of the invention is to provide a firearm safe that can be located visually or tactily.

Yet a further object of the invention is to provide a firearm safe shaped and dimensioned to be installed between existing structural members in a building.

BRIEF DESCRIPTION OF THE SEVERAL VIEWS OF THE DRAWINGS

These and other, further and more specific objects and advantages of the invention will be apparent from the following detailed description of the invention, taken in conjunction with the drawings, in which.

BRIEF SUMMARY OF THE INVENTION

Figure 1:
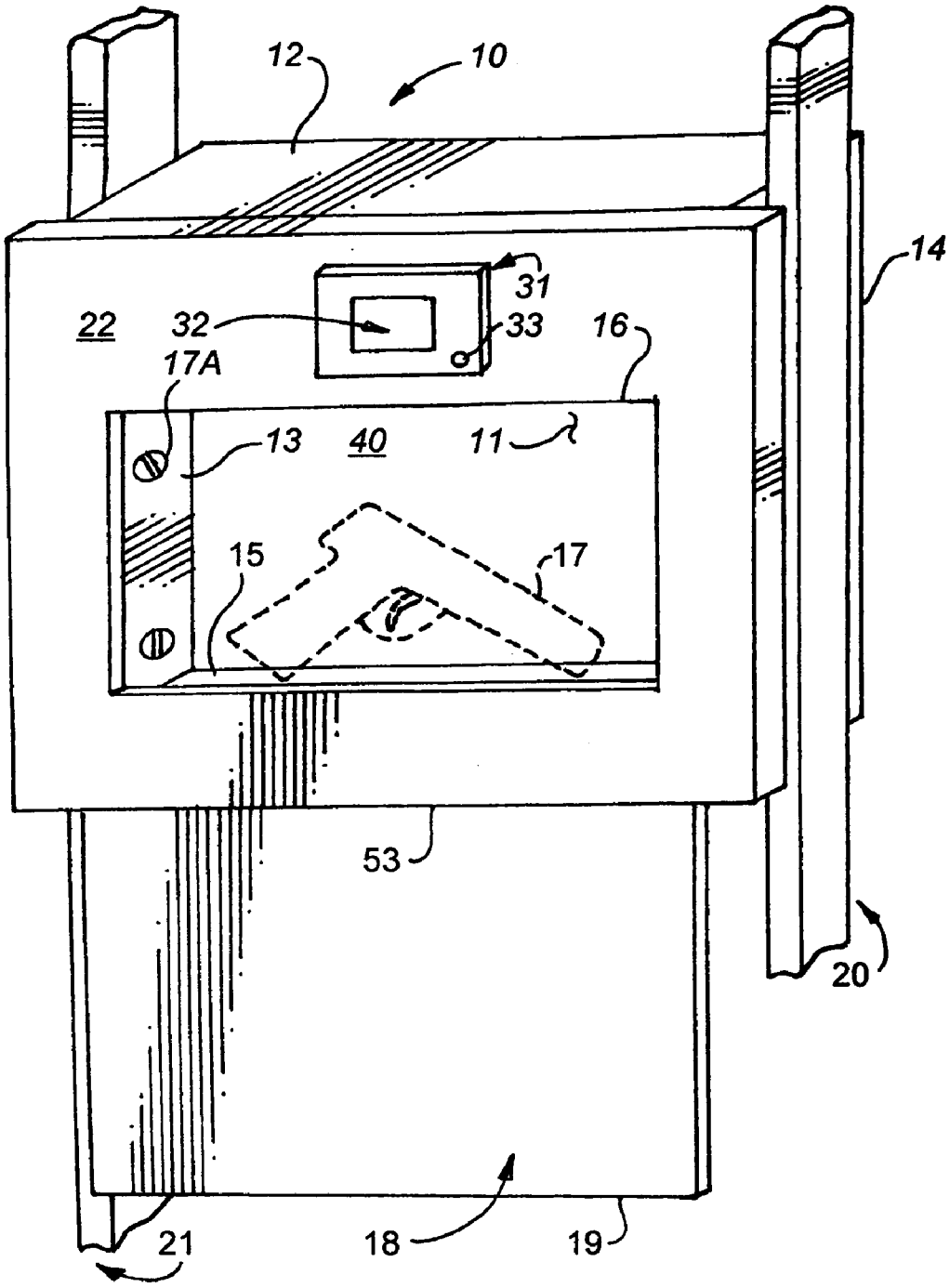
FIG. 1 is a perspective view illustrating a firearm safe constructed in accordance with the principles of the invention.

Briefly, in accordance with my invention, I provide improvements for safely providing protection for an individual. The improvements are provided in combination with a building structure that includes a floor, a wall, and a ceiling. The improvements include a safe mounted in one of a group consisting of the floor, the wall, the ceiling. The safe includes an interior and a door movable between at least two operative positions, a latched first closed position to prevent access to the interior, and an unlatched second open position to permit access to the interior. The door moves from the first position to the second position under gravity. A loaded ready-to-use firearm is in the interior of the safe.

In another embodiment of my invention, I provide improvements for safely providing protection for an individual. The improvements are provided in combination with a building structure including a floor, a wall, and a ceiling. The improvements include a safe mounted in one of a group consisting of the floor, the wall, and the ceiling. The safe includes an interior and a door movable between at least two operative positions, a latched first closed position to prevent access to said interior, and an unlatched second open position to permit access to the interior. A loaded ready-to-use firearm is in the interior of the safe. The safe also includes a system for using one of a pair including visual senses and tactile senses to locate the safe in the dark.

In a further embodiment of my invention, I provide an improved method for safely storing a loaded ready-to-use firearm. The method includes the step of providing a safe. The safe includes an interior; a door movable between at least two operative positions, a latched first closed position to prevent access to the interior, and an unlatched second open position to permit access to the interior. The safe also includes a programmable biometric control system for identifying a unique biometric physical characteristic of at least one user and programming the system to move the door from the first position to the second position when the user is adjacent the system and the system senses the unique biometric physical characteristic of the user. The method also includes the steps of installing the safe in a building structure; programming the control system to identify a unique biometric physical characteristic of a user; using the control system to move the door to the second open position; placing the loaded ready-to-use firearm in the interior of the safe; and, moving the door to the first closed position.

In still another embodiment of the invention, I provide improvements in combination with a building structure including a floor, a wall, and a ceiling. The wall includes an outer surface and at least one structural support member. The improvements provide protection for an individual residing in the building structure. The improvements include a safe mounted in the wall. The safe includes a housing inset in the wall and connected to the inner structural support member; an interior; a door slidably mounted on the housing; and, a coil spring attached to the door. The door has a selected weight and is moveable between at least two operative positions, a latched first closed position to prevent access to the interior, and an unlatched second open position to permit access to said interior. The door slidably moves from the first position to the second position under gravity. The housing is inset in the wall such that when the door moves from the first position to the second position, the door is generally parallel to and adjacent the outer surface of the wall. The coil generates a force acting upwardly on the door to offset at least a portion of the selected weight of the door. The force generally remains constant when the door moves from the first to the second position and extends the spring. The improvements also include a loaded ready-to-use firearm in the interior of the safe.

In still a further embodiment of the invention, I provide a method for accessing a loaded ready-to-use firearm in a building structure including a floor, a wall, and a ceiling, the wall including an outer surface and at least one structural support member, including the step of providing a safe. The safe comprises a housing including a front; an interior; a door slidably mounted on the housing; a coil spring attached to the door; a light; and, a programmable control system. The door has a selected weight and is movable between at least two operative positions, a latched first closed position to prevent access to the interior, and an unlatched second open position to permit access to the interior. The door slidably moves from the first position to the second position under gravity. The housing is shaped and dimensioned to be inset in the wall such that when the door moves from the first position to the second position, the door is generally parallel to and adjacent the outer surface of the wall. The spring generates a force acting upwardly on the door to offset at least a portion of the selected weight of the door, which force generally remains constant when the door moves from the first to the second position and extends the spring. The light is visible in the dark to identify the location in the wall of the safe. The control is operable to move the door from the first position to the second position. The method also includes the steps of installing the safe in the building structure in the wall such that the housing is inset in the wall and said front is generally flush with and parallel to the outer surface of the wall; programming the programmable control system; placing the loaded ready-to-use firearm in the interior of the safe; locating in the dark with the light the location of the safe in the wall; using the control system to move the door to the second open position; and, removing the loaded firearm from the interior of the safe.

DETAILED DESCRIPTION OF THE INVENTION

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a safe generally indicated by reference character 10. Safe 10 is utilized to store a firearm 17 or valuables or other articles. Safe 10 includes a housing have a top 12, bottom 15, side 13, side 14 and front or face 22. Rectangular opening 16 is formed in front 22. Safe 10 can have any desired shape and dimension. In one preferred embodiment, safe 10 is sized to be inserted between a pair of two-by-fours 20, 21 that are sixteen inches on center or twenty-four inches on center. Screws 17A are used to attach side 13 to two-by-four 21 and are used to attach side 14 to two-by-four 20.

Figure 2:
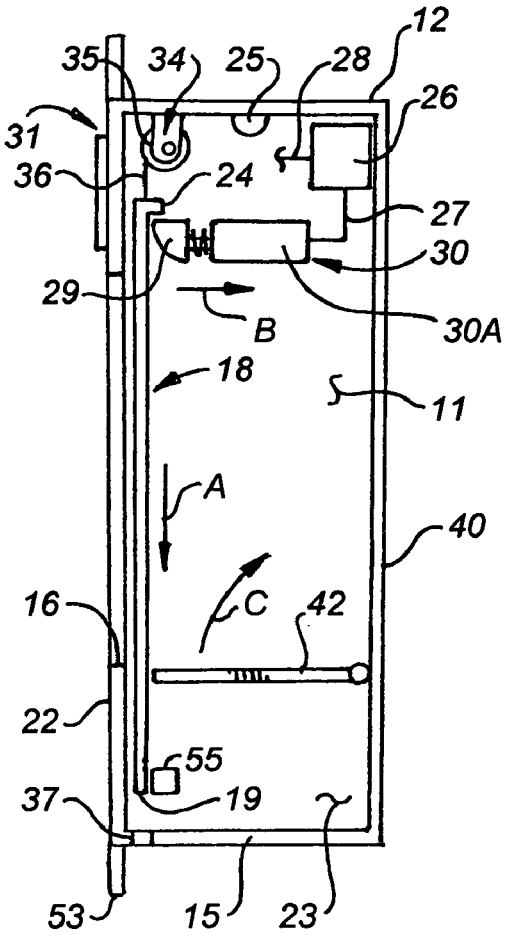
FIG. 2 is a side section view of the safe of FIG. 1 illustrating additional construction details thereof.
Figure 3:
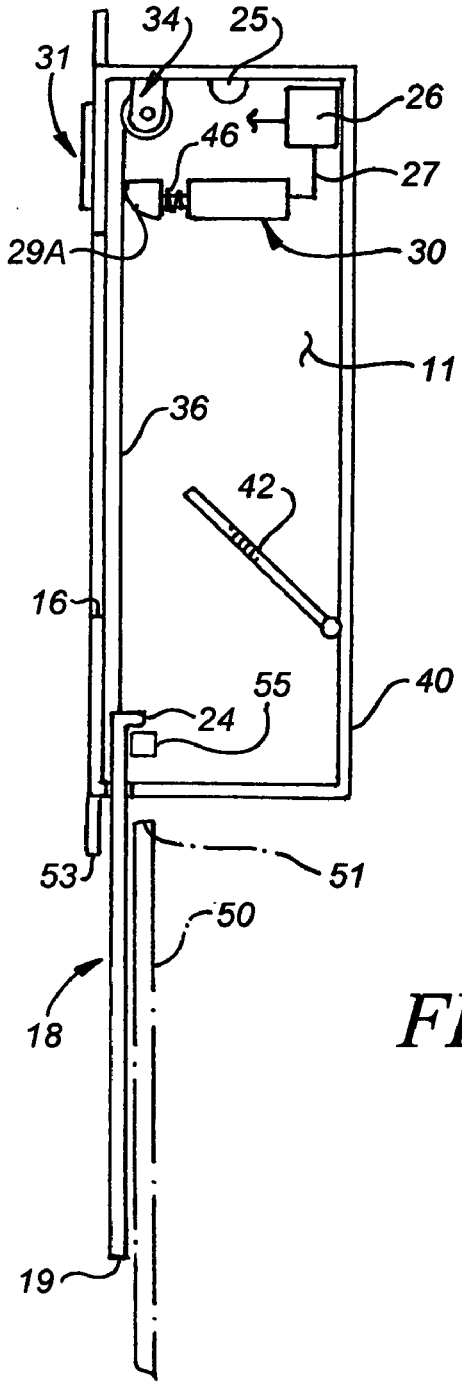
FIG. 3 is a side section view of the safe of FIG. 1 illustrating the mode of operation thereof.

Door 18 is slidably mounted in the housing and is movable between the closed operative position illustrated in FIG. 2 and the open operative position illustrated in FIGS. 1 and 3. When door 18 is in the closed operative position, door 18 prevents access to the interior space 11 of safe 10. When door 18 is in the open operative position, door 18 permits access into interior space 11 so that a firearm 17 or other article stored in safe 10 can be manually removed.

The tip of latch 29 of solenoid 30 extends under lip 24 of door 18 and maintains door 18 in the closed position illustrated in FIG. 2. Alternatively, door 18 can be magnetically or otherwise latched in a closed position. Body 30A of solenoid 30 is mounted in safe 10 in fixed position. Compressed spring 46 maintains latch 29 in a position distended from body 30 so latch 29 engages lip 24. When microprocessor 26 commands solenoid to displace latch 29 in the direction of arrow B, door 18 slides downwardly under gravity in the direction of arrow A. After a few seconds, and after lip 24 of door 18 has moved downwardly past latch 29, microprocessor 26 "releases" solenoid 30 so that spring 46 laterally and outwardly displaces latch 29 away from body 30A and back to the position illustrated in FIGS. 2 and 3.

Spring-loaded cable unit 34 includes pulley or spool 35, includes cable 36 connected to lip 24, and includes a spring means (not visible) that operates to cause cable 36 to coil back onto spool 35 after cable 36 has been unwound and extended from spool 35. When microprocessor 26 operates solenoid 30 to displace latch 29 to permit door 18 to open, spring loaded cable unit 34 functions to slow the downward displacement by gravity of door 18. Unit 34 also only permits door 18 to be downwardly displaced a selected distance. In FIG. 3, door 18 has downwardly traveled the greatest distance allowed by cable unit 34. Unit 34 is spring loaded in the manner of a measuring tape. When latch 29 is opened and permits door 18 to travel downwardly under gravity, the spring-loading of unit 34 is not great enough to prevent the initial downward travel of door 18. When, however, door 18 is upwardly displaced or lifted from the position shown in FIG. 3, unit 34 automatically rewinds or spools cable 36 on spool 35. Cushioned stops 55 quickly and silently slow and then stop the door 18 when it drops or travels downwardly under gravity.

Any desired mechanical or other system can be used to open or close door 18. Door 18 can open under the force of gravity or be opened (or closed) with a spring, motor, or other means. One advantage of the spool 35—cable 36 system illustrated in FIGS. 2 and 3 is that it can readily be manufactured such that when door 18 opens and closes, there is little, if any, noise produced. Such a "silent-running" of door 18 is a desirable function of a safe 10 utilized in the practice of the invention because when door 18 is opened or closed noise is not produced that alerts an intruder that a safe or other storage unit is being opened. If an auxiliary closure system is used for door 18 in place of the spool 35—cable 36 system illustrated in FIGS. 2 and 3, it is preferred, although not necessary, that the auxiliary system not generate sound, or that the auxiliary system only generate a minimal amount of sound when door 18 is opened or closed. In one embodiment of the invention, the sound generated when door 18 is opened is sufficiently quiet that a human being who has normal hearing and is located in a building structure outside the room in which safe 10 is located cannot hear door 18 being opened and/or closed. In another embodiment of the invention, the sound generated when door 18 is opened is sufficiently quiet that a human being who has normal hearing and is located in the room in which safe. 10 is located cannot hear door 18 being opened and/or closed. Spring loaded cable unit 34 assists the upward movement of door 18.

The user closes door by grasping lower edge 19, upwardly displacing or lifting door 18 in a direction of travel opposite that of arrow A, and pushing lip 24 past latch 29 to the position shown in FIG. 2 so that latch 29 is positioned beneath lip 24 and again prevents door 18 from traveling downwardly in the direction of arrow A. When door 18 is pushed upwardly in a directly opposite that of arrow A, lip 24 slides over a portion of the lower curved lower surface 29A of latch 29 and momentarily displaces spring-loaded latch 29 in the direction of arrow B to permit lip 24 to move upwardly past latch 29 to the position shown in FIG. 2. As soon as lip 24 "clears" latch 29, spring 46 displaced latch in a direction of travel opposite that indicated by arrow B such that latch 29 returns to the position illustrated in FIG. 2 and prevents door 18 from traveling downwardly under gravity in the direction of arrow A.

The latch system 29–30 can have any desired construction and can, for example, comprise a deadbolt type lock that is operated with a solenoid or some other means for providing motive power to open and close the latch.

Microprocessor 26 includes a battery (not visible). The battery provides power for microprocessor 26, light 25, and solenoid 30. Line or lines 27 connect microprocessor 26 to solenoid 30. Line or lines 28 connect microprocessor to the biometric detection unit 31. Unit 31 includes a touch sensitive screen 32 and includes a port 33 for receiving the electrical connector of a battery pack or other unit that provides auxiliary power to operate microprocessor 26 and light 25 in the event the battery in microprocessor 26 loses power.

Screen 32 senses the fingerprint of an individual when the fingertip is pressed against the screen 32. Unit 31 can, if desired, be adapted to detect biometric physical characteristics other than an individual's fingerprint. For example, unit 31 can perform a retina scan, or, unit 31 can analyze a person's DNA when a finger or hair strand is placed adjacent or in contact with unit 31. Unit 31 includes a system for programming microprocessor 26 to store an individual's biometric data in memory in microprocessor 26. The programming system can comprise, by way of example and not limitation, a keyboard that can be used to instruct microprocessor 26 to store in memory the fingerprint detected by sensor 31 when the user presses a finger against screen 32. Or, sensor 31 can include a disc reader. A disc including data defining an individual's fingerprint is placed in the disc reader. Data from the disc is stored in microprocessor 26. A variety of other systems and methods for programming a microprocessor 26 are well known in the art and are not detailed herein. If desired, the microprocessor 26 can be programmed to be voice activated.

Once the fingerprint is stored in the memory of microprocessor 26, microprocessor 26 will, when the user later places his finger against screen 32 to be detected by sensor 31, operate solenoid 30 to displace momentarily latch 29 in the direction of arrow B to permit door 18 to open downwardly in the direction of arrow A.

Safe 10 can also include a hinged false bottom 42 that normally is in the position illustrated in FIGS. 1 and 2, but that can be pivotally opened in the direction of arrow C in the manner illustrated in FIG. 3. Bottom 42 can be constructed to be opened in any desired manner or direction. Valuables can be stored in safe 10 beneath false bottom 42.

Screen 32 preferably is continuously lit, or at least is provided with light when the room or area in a building structure in which safe 10 is mounted is dark. Screen 32 can, for example, include a sensor that determines when it is dark and that illuminates screen 32 during darkness. The illumination of screen 32, or of some visible area on the front 22 of safe 10, is important in the practice of the invention because it enables an individual to readily locate safe 10 during darkness. Sensor 31 or front 22 can also include Braille or another pattern or pattern(s) that permit a user to locate safe 10, sensor 31, and/or screen 32 by touch. For example, when sensor 31 feels different than the surface of the wall surrounding safe 10, an individual can locate sensor using his or her sense of touch.

Firearm 17 can be stored in safe 10 in any desired configuration, i.e., loaded, unloaded, assembled, disassembled. The firearm 17 can also be fitted with a quick disconnect safety trigger or other auxiliary device when added security is desired. One advantage of the invention, however, is that a loaded, ready-to-use firearm 17 can be stored securely because only the person or persons with a fingerprint recognizable by microprocessor 26 can gain access to safe 10 by pressing their fingerprint against screen 32 to open door 18. As used herein, a ready-to-use firearm 17 is a firearm that be can fired as soon as an individual removes the firearm from safe 10. However, a ready-to-use firearm can include a safety that is "on" and that prevents the firearm from being fired. Even if the safety firearm 17 is on, firearm 17 is considered to be ready-to-use because the safety is normally disengaged with a simple press of a finger.

If the battery(s) that powers microprocessor 26 dies, power can be supplied via port 33 to operate microprocessor 26 so that the interior 11 of safe 10 can be accessed. If microprocessor 26 fails to operate properly, an auxiliary unit can be provided that can be connected to port 33 or some other portion of safe 10 to operate solenoid 30 to open door 18. If solenoid 30 fails to operate, safe 10 can be "drilled" or opened by a qualified safe expert. A key lock can, if desired, also be provided with safe 10 that will permit safe 10 to be accessed in the event solenoid 30 or microprocessor 26 fail to operate properly. The key lock can be hidden under a removable steel emblem and can be constructed to be operated using a special tool like an Allen wrench. Such a key lock is not presently preferred in the invention because the key to the lock can fall into the wrong hands.

In use, a safe 10 is provided along with mounting screws 17A. The safe 10 is sized to fit between a pair of two-by-fours that are spaced apart twenty-four inches (or sixteen inches or any other desired distance) on center. A room is selected in a building structure. A pair of two-by-fours 20, 21 are located in a wall that are spaced apart twenty-four inches on center. If desired, a pair of two-by-fours can also be located in the ceiling or floor of the room, or in an attic or shed. After the two-by-fours are located, an opening 51 is cut in the dry wall 50. The opening is sized to slidably received top 12, bottom 15, and sides 13, 14. Safe 10 is slid into the opening to a position comparable to that illustrated in FIG. 1. Screws 17A are turned through side 13 into two-by-four 21 and are turned through side 14 into two-by-four 20. When screws 17A have been installed and safe 10 is fixedly mounted in opening 51, the peripheral edge or lip 53 of safe 10 extends over and covers opening 51 in the manner illustrated in FIGS. 2 and 3. As is illustrated in FIG. 3, the front portion of safe 10 extends outwardly from drywall 50 (i.e., extends outwardly from the wall) a sufficient distance to permit door 18 to drop down in front of drywall 50 when door 18 is in the open position. If desired, safe 10 can be designed such door 18 drops down behind drywall 50 and inside the wall, in which case a system is provided in safe 10 to pull or otherwise displace door 18 upwardly from the open to the closed position. The advantage of having door 18 drop down in the manner shown in FIG. 3 is that door 18 can be manually upwardly displaced to the closed position in the manner earlier described.

Once safe 10 is installed in the wall, sensor 31 is used to program microprocessor 26 to recognize the fingerprint or other biometric characteristic of an individual or individuals. Thereafter, when the individual places his or her fingertip against screen 32, sensor 31 sends to microprocessor 26 data defining the fingerprint currently being viewed by the sensor. The microprocessor 26 compares the current fingerprint data with fingerprint data stored in the memory of microprocessor 26. If the fingerprints defined by the two sets of data match, microprocessor 26 operates solenoid 30 to open door 18. If the two sets of data do not match, microprocessor 26 does not open door 18. In one variation of the invention, the biometric sensor can detect and react to sound. In this case the microprocessor can be programmed to be voice activated and to open the safe door on detecting a verbal command from the individual who controls access to the safe. A keypad can also be provided that enables an individual to enter an access code via the keypad to open the safe.

The components—including memory and a controller—of microprocessor 26 are well known in the art, as are methods of manufacturing and programming a microprocessor 26 with an operating system and with means to store biometric data, to receive biometric data from sensor 31, and to compare stored biometric data with real time biometric data generated by sensor 31 when an individual places his or her fingerprint against screen 32. Sensor systems 31 "reading" a fingerprint and generating and transmitting data defining a fingerprint or other biometric data are also well known in the art.

One objective of the invention is to provide a safe that controls how the safe door opens, that opens the door quietly, and that minimizes friction and wear on the door and extends the operational life of the safe. The Rouse patent (U.S. Pat. No. 5,111,755) discloses a variety of safes each equipped doors that open by sliding downwardly under gravity:

> "The gun drawer 11 is designed to fit up within the opening in container 11 and slide down along the sides thereof so as to render as readily accessible a loaded handgun 13 . . . " Col. 4, lines 58 to 61.

> "In this embodiment, the front panel 221 slides downward with regard to container 211, thereby exposing gun 13 therewithin. " Col. 8, lines 59 to 61.

Stops are provided to "catch" drawer 11 and to arrest the downward fall of the drawer 11:

> "A drop support block 42 having spaces 47 for fit up with the bottom portion of guide rail 31 is provided on each side of container 11 to limit the downward travel of gun drawer 12 . . . . A foam rubber or other appropriate similar material member 51 is provided on the top surface of drop support blocks 42 to silently cushion the downward fall and stop of gun drawer 12 when it is released to gain access to the loaded gun 13, therein." Col. 6, lines 17 to 20; 21 to 26.

One disadvantage of the Rouse gun storage systems is that the doors are allowed to slide down under their own weight until the doors arrive at the stops. The rails and guides associated with the doors experience significant frictional forces and, consequently wear and loosen and, over time, tend to produce noise and to no longer operate "silently".

Figure 4:
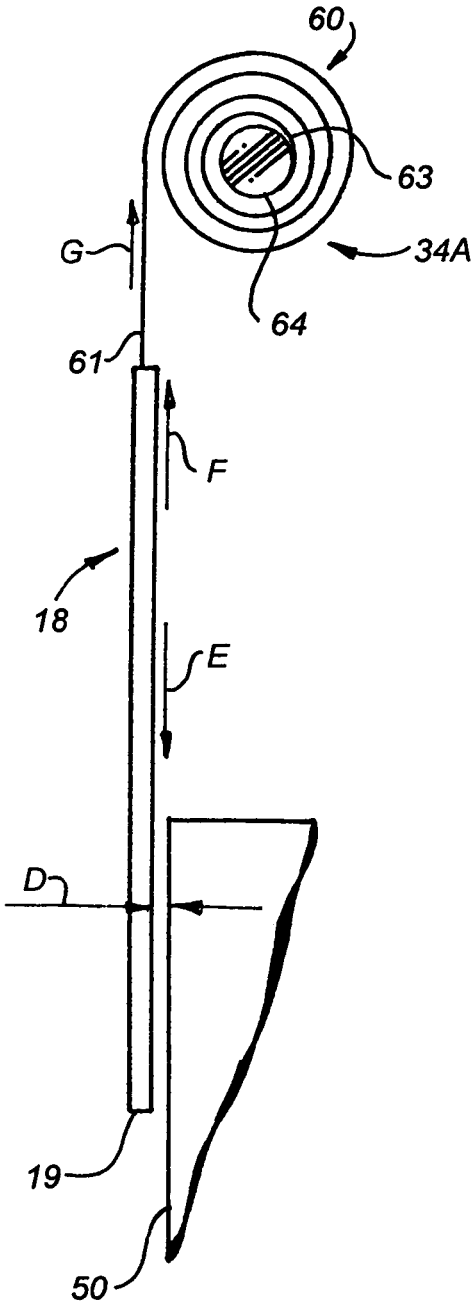
FIG. 4 is a side view illustrating the use of an alternate spring system and fluid friction to control the opening of the door to the firearm safe of FIG. 1; and, FIG. 5 is a perspective view further illustrating the spring system of FIG. 4.
Figure 5:
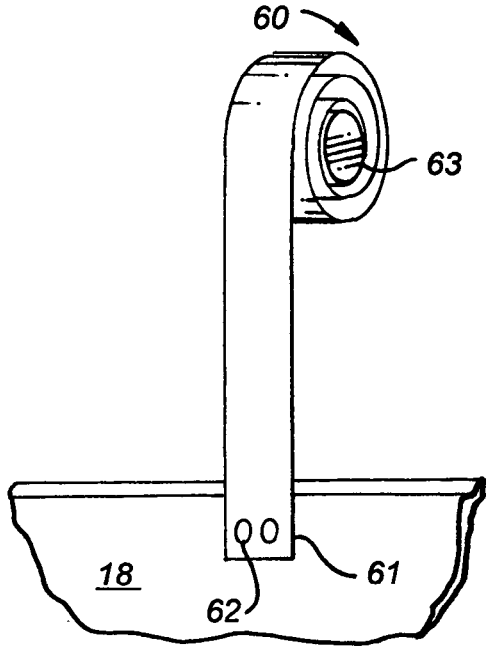

FIGS. 4 and 5 illustrate a flat coil spring system 34A that can be substituted for the spring loaded cable unit 34. Coiled flat spring 60 is mounted on a spindle or axle 64. The spindle 64 normally, although not necessarily, is mounted inside safe 10 and is fixedly secured to the back 40 or to another portion of safe 10. End 63 of spring 60 is not attached to spindle 64 and is free to move over the outer cylindrical surface of spindle 64. End 61 of spring 60 is secured to the top of door 18 with rivets 62 (FIG. 5) or other fastening means.

Spring 60 generally provides a force that acts upwardly in the direction of arrow G, that significantly offsets the weight of door 18, and that maintains a generally constant magnitude when door 18 drops and pulls one end 61 of spring 60 downwardly. If, for sake of discussion, the weight of door 18 is four and one-half pounds, the magnitude of force G is preferably slightly less than the weight of the door 18. The magnitude of force G is preferably at least 80% of the weight of door 18, preferably is at least 90% of the weight of door 18, and most preferably is at least 95% of the weight of door 18. For example, the magnitude of force G typically would be 0.2 pound less than the weight of door 18 and would therefore be 4.3 pounds. The 0.2 pound differential between force G and the weight of door 18 is substantially offset by rail and/or guide friction produced as the door 18 moves downwardly, and a very controlled, silent door drop results. If door 18 were simply allowed to fall under its own weight and spring system 34A were not utilized, then the frictional forces would be much greater. Providing spring system 34A to generate a force G with a magnitude of 4.3 pounds reduces by over ninety percent the surface-to-surface frictional forces that are generated and that act on door 18 when door 18 travels downwardly. The spring system 34A does not require foam "bumpers" of the type described in the Rouse patent to halt silently the fall of door 18, or only requires smaller bumpers. Door 18 ordinarily will operate for extended periods of time without developing squeaks or without sticking due to frictional forces and wear acting on door 18.

Surface friction generates forces that act to slow or prevent the movement of an object moving over a surface. The movement of air and other fluids is slowed due to surface friction produced when the air moves over the surface of a solid object. The frictional forces generated by the ground can cause the wind to slow down by about 20%. A 20-knot wind will be slowed to 16 knots along the ground.

Air friction, or air drag, also generates forces that act to slow the movement of an object. The greater the surface area of an object, the greater the magnitude of frictional forces produced when the object moves through air. Air friction typically produces only minor wear on an object.

The system illustrated in FIG. 4 for opening door 18 utilizes a combination of surface friction and air friction to slow the downward movement of door 18. This is achieved in large part because door 18 is positioned near wall 50. The distance indicated by arrow D is less than about one-half inch, preferably is less than about one-eighth of an inch, and most preferably is less than about one-sixteenth of an inch. As used herein, "about" indicates that a measurement is within one thirty-second of an inch. About one-half inch means one-half inch plus or minus one-thirty-second of an inch.

The distance D is small so that when door 18 moves downwardly and "drags" air with door 18 in the direction of arrow E, the downward movement of the air is impeded by friction generated when the air moves over the surface of wall 50. When the downward movement of air is impeded, the air produces additional frictional forces impeding the downward movement of door 18. The frictional forces that are generated by air friction and surface friction are small when compared to the 4.3 pound force G generated by spring system 34A. Since, however, the resultant force acting on door 18 in the direction of arrow E is only 0.2 pounds, the air and surface frictional forces that interfere with the movement of door 18 in the direction of arrow E have significance and contribute to the "quiet running" of door 18 and to the operational life of door 18. Consequently, the travel of door 18 adjacent wall 50 is one important feature of the invention. In one preferred embodiment of the invention, door 18 is immediately adjacent, contacts and lightly slides over or skims the surface of wall 50.

Having described my invention in such terms as to enable those of skill in the art to make and practice it, and having described the presently preferred embodiments.

I claim:

1. In combination with a building structure including a floor, a wall having an exterior outer surface, and a ceiling, the wall including and at least one structural support member, the improvements for safely providing protection for an individual residing in the building structure, said improvements including (a) a safe mounted in the wall, said safe including (i) a housing inset in the wall and connected to the structural support member, said housing including a front portion, (ii) an interior, (iii) a door slidably mounted on said housing and having a selected weight and movable between at least two operative positions, a latched first closed position to prevent access to said interior, and an unlatched second open position to permit access to said interior, said door slidably moving from said first position to said second position under gravity, and said housing inset in the wall such that said front portion extends outwardly away from said wall and from the exterior outer surface a distance sufficient to permit said door to be generally parallel to and adjacent and extend over a portion of the exterior outer surface when said door moves from said first position to said second position, (iv) a coil spring attached to said door to generate a force acting upwardly on said door to offset at least a portion of said selected weight of said door, said force generally remaining constant when said door moves from said first to said second position and extends said spring; and, (b) a loaded ready-to-use firearm in said interior of said safe.

2. The combination of claim 1 wherein in said second position said door is less than about one-half inch from the exterior outer surface of the wall.

3. The combination of claim 1 wherein in said second position said door is less than about one-eighth inch from the exterior outer surface of the wall.

4. The combination of claim 1 wherein in said second position said door is less than about one-sixteenth inch from the exterior outer surface of the wall.

5. A method for accessing a loaded ready-to-use firearm in the dark in a building structure including a floor, a wall, and a ceiling, the wall including an exterior outer surface and at least one structural support member, including the steps of (a) providing a safe comprising (i) a housing including a front portion, (ii) an interior, (iii) a door slidably mounted on said housing and having a selected weight and movable between at least two operative positions, a latched first closed position to prevent access to said interior, and an unlatched second open position to permit access to said interior, said door slidably moving from said first position to said second position under gravity, and said housing shaped and dimensioned to be inset in the wall such that said front portion extends outwardly away from said wall and from the exterior outer surface a distance sufficient to permit said door to be generally parallel to and adjacent and extend over a portion of the exterior outer surface when said door moves from said first position to said second position, (iv) a coil spring attached to said door to generate a force acting upwardly on said door to offset at least a portion of said selected weight of said door, said force generally remaining constant when said door moves from said first to said second position and extends said spring, said spring having first and second ends, (v) a light visible in the dark to identify the location in the wall of the safe, (iv) a programmable control system operable to permit said door to move from said first position to said second position;

(b) installing said safe in the building structure in the wall such that said housing is inset in the wall and said front portion extends outwardly away from said wall and from the exterior outer surface a distance sufficient to permit said door to be generally parallel to and adjacent and extend over a portion of the exterior outer surface and generally flush with and parallel to the outer surface of the wall;

(c) programming said programmable control system;

(d) placing the loaded ready-to-use firearm in said interior of said safe;

(e) locating in the dark with said light the location of said safe in the wall;

(f) using said control system to permit said door to move to said second open position; and, (g) removing the loaded firearm from said interior of said safe.

6. The method of claim 5 wherein (a) said coil spring comprises a flat wound strip;

(b) said door, when moving from said first to said second position, pulls outwardly one of said ends of and uncoils said spring.

7. The method of claim 5 wherein in said second position said door is less than about one-half inch from the exterior outer surface of the wall.

8. The method of claim 6 wherein in said second position said door is less than about one-half inch from the exterior outer surface of the wall.

9. The method of claim 5 wherein in said second position said door is less than about one-eighth inch from the exterior outer surface of the wall.

10. The method of claim 6 wherein in said second position said door is less than about one-eighth inch from the exterior outer surface of the wall.

11. The method of claim 5 wherein in said second position said door is less than about one-sixteenth inch from the exterior outer surface of the wall.

12. The method of claim 6 wherein in said second position said door is less than about one-sixteenth inch from the exterior outer surface of the wall.

13. In combination with a building structure including a floor, a wall having an exterior outer surface, and a ceiling, the wall including and at least one structural support member, the improvements for safely providing protection for an individual residing in the building structure, said improvements including (a) a safe mounted in the wall, said safe including (i) a housing inset in the wall and connected to the structural support member, said housing including a front portion, (ii) an interior, (iii) a door slidably mounted on said housing and having a selected weight and movable between at least two operative positions, a first closed position to prevent access to said interior, and a second open position to permit access to said interior, said door slidably moving from said first position to said second position under gravity, and said housing inset in the wall such that said door is generally parallel to and adjacent and extends over a portion of the wall when said door moves from said first position to said second position, (iv) a flat coil spring including first and second ends and attached to said door to generate a force acting upwardly on said door to offset at least a portion of said selected weight of said door, said force generally remaining constant when said door moves from said first to said second position and extends said spring; and, said door, when moving from said first to said second position, uncoiling said spring and pulling outwardly one of said ends of said spring;

(b) a loaded ready-to-use firearm in said interior of said safe.

14. The combination of claim 13 wherein in said second position said door is less than about one-half inch from the wall.

15. The combination of claim 13 wherein in said second position said door is less than about one-eighth inch from the wall.

16. The combination of claim 13 wherein in said second position said door is less than about one-sixteenth inch from the wall.

17. The combination of claim 13 wherein in said second position said door extends over a portion of the exterior outer surface of the wall.

* * * * *